US006139443A

United States Patent [19]

Reynolds

[11] Patent Number: 6,139,443

[45] **Date of Patent: *Oct. 31, 2000**

[54] TURF-SIMULATING DEVICE

[75] Inventor: Richard C. Reynolds, North Wales, Pa.

[73] Assignee: Reyntech Corp., North Wales, Pa.

[ * ] Notice: This patent is subject to a terminal disclaimer.

[21] Appl. No.: 09/104,598

[22] Filed: Jun. 24, 1998

Related U.S. Application Data

[63] Continuation-in-part of application No. 08/881,341, Jun. 24, 1997, Pat. No. 5,830,080.

[51] Int. Cl.[7] ..... A63B 69/36

[52] U.S. Cl. ..... 473/278; 273/DIG. 8

[58] Field of Search ..... 473/278, 279; 273/DIG. 8

[56] References Cited

U.S. PATENT DOCUMENTS

| | | | |
|---|---|---|---|
| 3,639,923 | 2/1972 | Stewart | 473/279 X |
| 3,880,432 | 4/1975 | Coffey et al. | 273/195 A |
| 3,995,079 | 11/1976 | Haas | 428/17 |
| 4,130,283 | 12/1978 | Lindquist | 473/278 X |
| 4,387,896 | 6/1983 | O'Brien | 273/195 A |
| 4,844,470 | 7/1989 | Hammon et al. | 273/195 A |
| 4,902,541 | 2/1990 | Martino | 428/17 |
| 4,913,442 | 4/1990 | Walker | 273/195 A |
| 4,932,663 | 6/1990 | Makar | 273/195 A |
| 5,004,243 | 4/1991 | Dlouhy | 273/195 A |
| 5,026,580 | 6/1991 | Hammon | 428/17 |
| 5,028,052 | 7/1991 | Miller | 273/195 A |
| 5,035,433 | 7/1991 | Durso | 273/187 A |
| 5,205,562 | 4/1993 | Hammon | 473/278 |
| 5,273,285 | 12/1993 | Long | 273/195 A |
| 5,830,080 | 11/1998 | Reynolds | 473/278 |
| 5,902,190 | 5/1999 | Masutani et al. | 473/378 X |

*Primary Examiner*—Sam Rimell
*Attorney, Agent, or Firm*—Elman & Associates

[57] ABSTRACT

A turf-simulating surface and golf practice tee device simulates the properties of natural turf. The device is made of independent components which simulate the layers of natural soil. One component is a composite mat comprising an integral pile section and plastic foam layer. The pile section has tufted strands that simulate grass, and a loop portion that is interactively positioned in a lateral-strength fabric. A plastic foam element is bonded to both the lateral-strength fabric and to the looped regions of the pile section. A second component is a rimmed base that simulates the supporting properties of the deeper layers of natural soil. The rim of the rimmed base is integrally formed around a engineered-plastic composite core. A third component is a tee-block that comprises a first component material element and a gel-foam tee-retaining element.

16 Claims, 5 Drawing Sheets

TURF-SIMULATING DEVICE

RELATED U.S. APPLICATION

This is a Continuation-in-part of Application No. 08/881,341, filed Jun. 24, 1997, U.S. Pat. No. 5,830,080 to Reynolds, issued Nov. 3, 1998.

FIELD OF THE INVENTION

This invention relates to an artificial turf product designed to simulate the basic properties of natural turf and a method for making it.

BACKGROUND OF THE INVENTION

Artificial turf athletic mats for use for golf practice, or on a golf driving range, desirably have a particular set of physical properties. First, it is desirable to utilize a grass-like surface to simulate a grass golf course natural turf and surface. Second, the underlying support for such a mat is very important because golfers swing long, relatively heavy clubs, with great force. Should the club head ground on an unyielding surface, the surface, the club, and the golfer, may be injured. Third, on practice ranges, the surfaces of golf mats are subject to great wear because of the high level of use and frequent abuse. Previously disclosed mats have been found to be less than entirely satisfactory because they do not effectively simulate natural conditions and they wear too rapidly when in use.

Golf tee shots require the golf club to be swung so that the head passes cleanly through the position of the ball without impacting the ground surface. Practice surfaces used at driving ranges for tee shots should, however, deform to allow passage of the club head should the golfer strike the ball inexpertly and the club head inadvertently make contact with the practice surface. The surface should remain substantially undamaged so that a golfer may put in the hours of practice needed to obtain the desired level of proficiency. Previously disclosed mats have not satisfactorily met this need.

Golf fairway shots require the golf club to be swung so that the head passes through the position of the ball and on into the ground surface so as to displace a portion of turf, a "divot." Practice surfaces for fairway shots should deform to allow passage of the club head, provide sufficient resistance to give the "feel" of taking a divot, and remain undamaged so that a golfer may put in the hours of practice needed to obtain the desired level of proficiency.

Natural turf has a structure that can be described as four general layers. Each layer has properties that affect the performance of the overall playing surface. The layers differ by function and the type of material they have in them. The layers are described herein as the grass layer, the vegetative layer, the root-biomass layer and the root-soil layer. The grass layer consists largely of the grass blades on which the golf ball lies when in play. The primary variable characteristic of this layer is the length of the grass blades. On a golf course fairway, grass is generally maintained at a uniform level that varies depending upon the species of grass used on the course. For example, "Bent grass" courses are maintained at about 0.6 cm (¼ inch) and rye grass courses at about 1.25 cm (½ inch). In the rough, the grass blade length may vary widely as discussed below.

The vegetative layer is the layer where the grass blades join into the main vegetative meristem ("stem") of the grass plant and is the region from which the plant grows. The vegetative layer is thin, firm, springy and supportive. The support is formed by the connections between the grass blades of the first layer, the stems of the second layer and the roots of the third layer. The vegetative layer is generally only 0.3 cm (⅛ inch) to 0.6 cm (¼ inch) high with stems about 2 mm (3/32 inch) in diameter depending on the grass species and the mown height of the grass. The overall height of the vegetative layer is directly proportional to the grass blade length, e.g., in 5 cm (2 inch) high rough the vegetative layer might be 1.25 cm (½ inch) high and composed of stems 0.45 cm (3/16 inch) thick. Such rough offers substantial resistance to the passage of a club head. If grass grows past 1.9 cm (¾ inch) in height, it begins to form a thatch, a build-up of interwoven live and dead grass, which increases the depth and density of this layer to an extent unsuitable for golf. Thatch is one reason why rough is so difficult to play. Keeping the grass 1.25 cm (½ inch) or less in height prevents the development of thatch and maintains direct access to the root-soil layer.

The structural integrity of the vegetative layer of the fairway offers little resistance to the passage of the club head because of the lack of thatch. The club head has sufficient mass and speed, and also has a sharp leading edge that enables it to cut through the turf. The integrity of the vegetative layer provides a vertical support matrix that holds a divot together and maintains the structure of the turf surrounding the divot until it is replaced. Without this structure a divot would fragment into its individual components. Dynamically, the divot flies just after and along the same relative path as the ball until air resistance slows it down.

The root-biomass layer of natural turf is extremely complex and is composed of the grass roots, living and dead organic material, mineral particles, air, water, and a variety of living organisms. The activities of the living organisms of the root-biomass layer (the biomass) constantly work to break down minerals and other materials to particles of critical size. The action of living organisms has a significant effect on the health of soil and plant life, and also has important effects on the performance characteristics of the turf.

On a golf course the root-biomass layer is usually about 50-percent space and 50-percent solid material. Grass roots help living organisms break up the soil and allow air and water to penetrate into the ground. Roots also establish vertical and horizontal integrity. They grow down to access water and out to increase their surface area for absorbing nutrients. The natural growth of roots gives turf its ability to repair itself. The 50-percent of space is about half filled with water which forms a thin film over almost all particles and materials in the layer. Through the playing season decaying material builds up, and constant activity compacts the turf. Golf courses aerate the turf twice a year to remove a percentage of the solid material so as to alleviate compaction and maintain the 50/50 ratio. Below the first 5 cm (2 inches) the amount of space decreases with increasing depth.

The grass roots provide a structural integrity that holds the turf together in the face of natural forces and that holds a divot together when it is displaced by stroke of a golf club. In a divot struck from natural grass, the soil stays trapped in the roots of a divot so that turf rapidly regrows when the divot is replaced. However, the degree to which the other materials are present affects how a club head will cut through the soil. The root-biomass layer is usually 2–3 cm (an inch or so) thick, depending on the grass species and the soil type. The horizontal growth of roots forms a matrix throughout the biomass layer that keeps the soil consistently loose and elastic. Most horizontal root growth occurs in the top 3.8 cm (1½ inches) and takes advantage of the nutrients present in the biomass layer. Roots penetrate significantly into the fourth layer. In summer, healthy grass roots grow 20–35 cm (8–14 inches) or more into the soil, depending on the species, the health of the soil, and the availability of water. Roots help link the third and fourth layers of the soil together and increase the flexibility of the root-soil layer. The third and fourth layers are also linked together by the physical interactions of the inorganic materials.

The fourth, or root-soil layer, consists of the soil below the horizontal roots of the root-biomass layer. Other than the roots, this layer is compositionally similar to the third layer. However, incidence of living organisms declines with depth and the density of the soil increases with depth due to increased packing of the soil. The root-soil layer provides a firm base that supports the flexibility of the top three layers. The root-soil layer extends indefinitely below the surface, but meaningful texture and air infiltration is found only in the upper 5 cm (2 inches) of the root-soil layer.

The grass on golf courses is deliberately cut to different lengths on different regions of the course. On fairways, the grass is usually cut to 1.25 cm (½ inch) or less in height. This short grass makes playing conditions uniform and, permits more consistent play because the variability of the surface is diminished. The grass on greens and tees is usually cut to 0.6 cm (¼ inch) or less in height. The player has a great deal more control over the ball when the ball is so close to the ground. However, while the effect of the grass is diminished, the soil still has a significant role in affecting play.

The "rough" of a golf course is of various lengths, generally no shorter than 2.5 cm (1 inch) and up to lengths of 7.5–10 cm (3–4 inches). A ball that is sitting down in deep rough, i.e. rough that is higher than 5 cm (2 inches), is very difficult to hit. Deep-rough grass is long and thick. It wraps around the club head and impedes its path to the ball. The ball will likely fly only a short distance compared to the distance the ball would fly if struck from the fairway. When the ball lies in short rough, several ball flights are possible, and the golfer has little control over the distance in this situation as well. For example, if the grass acts as a tee, the ball sits up and a player could hit the ball much further than intended. Practice tee areas are cut to fairway height to make practice more consistent for the player.

In areas such as deep rough or a bunker, the golf club cannot cut through very well because there is just too much resistance. However, bunkers are made of sand, a type of soil preparation which is uniform and consistent in its reactive qualities. Skilled players can use their skill to hit accurate, consistent shots from bunkers.

Golf players deliver force to the surface in two ways. As the player makes a stroke, turf is impacted in two places. First, as the club head strikes down and through the turf surface and strikes the ball and natural turf, the force of the impact radiates out and down about 5–7.5 cm (2–3 inches). Second, the cleats of the shoes of the player create a shearing force on the turf as they push and twist through the stroke. The action of the golfer's feet can cause substantial wear because at a practice area, the player stands and hits from one position.

In golf, force is delivered to the playing, or "striking," surface by the impact of the club head. Golf balls and golf clubs are designed to propel balls with backspin in order to affect and control the distance and direction of the flight of the ball. The club is designed to trap the ball between the face of the club and the ground so that the club face can exert a greater spin force on the ball. Forces are applied to a golf surface by the ball as it is trapped between the club head and the surface and by the club head directly. Forces are applied by the head as it swings through the line of travel, such forces may be delivered at speeds from about 100 cm/sec (a few miles per hour) up to 6700 cm per second (150 mile per hour) with compression loads from almost zero up to 140 Kg per square cm (2,000 pounds per square inch). Force is also delivered as the club head rotates about the axis of the club shaft. Shear forces may occur at up to 30° from the direction of application of the direct force due to the rotation of the club shaft and the curvature of the club head path. The properties of the surface therefore have a great effect on results achieved with the club.

Natural turf practice areas are not readily available in urban areas, and many artificial turf devices have been developed over the years in an attempt to accurately simulate the feel of natural turf to the golfer. Previously disclosed artificial golf mats have portions that can move in response to the impact of a club head. Such mats use springs, rubber bands, or the like to provide a movable surface. Other golf mats have artificial turf surfaces made of belts that move along the path of travel of the club head. These devices have achieved some success, but in general have proved too complex, too unreliable, or too cumbersome or non-portable for regular golf use.

Other prior art discloses mats for golf that are a simple rubber mat, some embodiments having a pile surface and others having a textured rubber surface. Polyurethane has also been used to form a golf mat, usually by being adhered to the back of a tufted carpet material. Such arrangements have not been found acceptable because the polyurethane pad and the tufted layer easily de-laminate, and the entire mat often fails to withstand the blows from the club head and rips into pieces.

Still other disclosed golf practice mats comprise an artificial turf surface bonded to a base formed of foam rubber or other multilayered materials. These devices are less complex than those having movable portions, but again have not proven totally successful because they do not accurately simulate the feel of natural turf to the golfer and tend to de-laminate along their edges or internally as the layers of which they are composed become separated. Other mats that have been made sufficiently strongly to avoid delamination are rigid and provide an unnatural feel when used.

Golf mats conventionally used at driving ranges have a very short lifetime because of the damage done to the mat in the area of the tee. Golfers practicing their tee shots will often hit the mat with a club rather than cleanly hit the ball off of the tee. Previously disclosed mats cannot withstand the substantial forces received by the mat under these conditions and become locally worn beyond use.

Previously disclosed golf mats have tended to be vulnerable to weathering. Exposure to ultra-violet light, heat from the sun and water from rain affect the long term quality of any surface. The artificial materials previously disclosed have proved unable to resist the radiation and heating effects of the sun. Open-celled foams that have been previously disclosed have a tendency to absorb water when exposed to the elements. All foams suffer from hydrophilic degradation. Open-celled foams, however, absorb and hold moisture that promotes degradation.

Because the many previously disclosed golf mats are multilayer constructs, their novel aspects primarily involve the bond between an artificial grass surface and a supportive substrate.

SUMMARY OF THE INVENTION

The present invention relates generally to a turf-simulating device that provides a composite surface for golf or other use and that accurately simulates the four-layered structure of natural turf, e.g. to a golfer practicing golf shots thereon. The present invention provides a turf-simulating device comprising: a pad comprising a turf-simulating composite, and a supportive base with a rim to laterally position the pad, the supportive base comprising a primary core and a secondary core. A preferred embodiment of the present invention comprises a supportive base, tee-blocks and a playing surface formed from a turf-simulating composite mat. Together the three components simulate the four-layer structure and playing properties of natural turf.

The turf-simulating composite mat of the present invention forms a main pad and a pair of tee pads. The supportive base of the present invention has a rim that serves to locate the main pad and the tee-pads and to prevent lateral movement of the pads. The supportive base is formed of a centrally located primary core surrounded by a peripheral secondary core which has recesses in its upper surface to accept the tee-blocks of the invention. Tee-blocks with vertically oriented tee-holding flanges sit in the recesses in the secondary core and are held in place by the main pad and the tee pads which have appropriately shaped cut-outs which surround the vertically oriented tee-holding flanges. When assembled the top edges of the vertically oriented tee-holding flanges protrude slightly above the surface of the main pad and the tee pads to serve as buffers and resist the action of a golf club.

The turf-simulating composite mat comprises an integrally formed structure with a pile upper surface, a lateral-strength fabric and a supporting plastic-foam element which is fully described in U.S. Pat. No. 5,830,080 the disclosure of which is incorporated herein by reference. The supporting plastic-foam element is of substantially uniform density and can be made with different densities to match the playing conditions found in different geographic regions. The pile upper surface of the turf-simulating composite has a loop portion at its base. The loop portion interacts with the lateral-strength fabric and the supporting plastic-foam element to encapsulate and physically bond to the lateral-strength fabric and to the loop portion of the pile element. In a preferred embodiment of the invention the supporting plastic-foam element is 2.5 cm (1 inch) in depth.

The supportive base of the present invention provides a recess in which the turf-simulating composite mat lies. The supportive base comprises an engineered plastic primary core that simulates the root-soil layers of natural turf. In a preferred embodiment, the engineered plastic primary core is surrounded by a vacuum-formed secondary core with recesses therein to receive tee-blocks which are also an invention. The secondary core is bonded to the primary core by an inner elastomer ring and is also bonded to a surrounding elastomer rim which is shaped to form a recess that accepts the turf-simulating composite mat. The rimmed base provides a strong and consistent support for the mat and provides additional shock absorbing features to absorb and dissipate the impact shock from the club head. The materials of the base are strong and resilient enough to resist the continual movements when in use and to maintain a level and uniform striking surface.

The secondary core may also be made by a variety of processes including, thermo-forming, spin-forming, the so-called "RIM" process (Rotational Injection Molding), blow molding or the secondary core may be cast.

Certain embodiments of the base have integral reinforcing bars located within the secondary core. In other embodiments of the invention the secondary core is replaced by an integral foamed-plastic element that interacts with the primary core and a preformed elastomer rim. Embodiments of the secondary core generally have drain holes passing through to the soil to allow for the escape of water. Other embodiments of the secondary core have the form of a lattice having vertically oriented rectangular, hexagonal (e.g., honey-comb) or other shaped holes therethrough to allow for the escape of water.

The turf-simulating composite mat of the present invention is formed as a main pad and a tee pad that both fit within the base and which flank and surround a tee-receptive slit of a tee block to form a substantially flat surface from which a player can hit teed-up golf balls with a natural-like experience.

Tee-blocks of the present invention provide a tee-receptive slit lined with a tee-retaining self-tacky gel-foam material which allows natural-like positioning of tees. The tee-retaining self-tacky gel-foam material may be a cast or extruded thermoplastic material as listed in Table 4.

It is desirable that the look, feel, texture, and resilience of the artificial surface should closely simulate the properties of natural turf. Accordingly, it is an object of the present invention to provide an artificial surface for golf mats and driving ranges that has properties that simulate the properties of naturally grassed golf courses and is capable of withstanding heavy wear.

Particularly, the present invention effectively emulates the performance relationship of the natural layers between the grass and the underlying soil. Accordingly, the present invention provides acceptable levels of force feedback, and shock and vibration are rebounded at levels that provide a natural-like experience to the golfer. Emulation of the supporting properties of the root-biomass layer and the force-absorbing and force-reflecting properties of the root-soil layer are provided by the composite mat and the base of the present invention.

An object of the present invention is to provide a practice surface that simulates ground properties in a way that introduces a dynamic interaction at the same level that natural turf does. The invention disclosed herein effectively simulates the response of natural turf. Natural turf responds to such forces as swing velocity, impact load, and energy absorption (as determined by deceleration of the club head) and provides a corresponding rebound. The effects of these forces are simulated by the present invention.

The durability of artificial turf depends on the compression set of the supportive structures and the resistance of the overall mat to degradation and abrasion. Compression set is determined by the cell memory of the material, i.e. the way individual cells are deformed and recover from deformation. Compression set and compression deflection are important properties of the materials used in the present invention. Compression set is also affected by the ability of a material to handle the long-term effects of passive and active loading.

Compression deflection is a measure of the ability of a material to handle immediate forces placed upon it, and also the consistency with which a material handles each individual event. Thus, a further object of the invention is to provide a surface that will deform and recover from deformation in a manner similar to natural turf. Urethane foams used in preferred embodiments of the present invention have superior consistency and provide these properties particularly well.

A method of making a turf-simulating composite is also part of the invention. A preferred embodiment of the device is made by first making a lateral-strength fabric with a pile surface formed thereon. The pile section is formed by passing a loop portion of each pile strand around the strands of the lateral-strength fabric so as to interactively associate the pile strands and the lateral-strength fabric and leave a filament portion upstanding from the fabric. A plastic-foam element is then formed so that the plastic foam encapsulates and physically bonds to the lateral-strength fabric and to the loop portion of the pile surface.

Another embodiment of the invention disclosed herein that simulates the four-layer properties of natural turf is a golf practice surface made of two independent components. In this embodiment the first component is a mat that comprises an integrally formed composite of pile, fabric and plastic foam, that simulates the grass, vegetative and root-biomass layers of natural soil. The second component of this embodiment is a rimmed base with a engineered plastic composite core that simulates the root-soil layers of natural turf. The second component provides a strong and consistent support for the mat and provides additional shock absorbing features to absorb and dissipate the impact shock from the club head. The base is made of material that is strong and resilient enough to resist the continual movements when in use and to maintain a level and uniform striking surface. The base mimics the relevant performance characteristics of the fourth layer of natural soil. Embodiments of the base may have drain holes passing through to the soil to allow for the escape of water. The present invention has no moving portions, has a simulated grass surface, has sufficient durability to be practicable and may be placed in the ground so that the surface is level with the natural turf. A particular advantage of the present invention is that rain water drains more rapidly from the playing surface than from natural turf thereby permitting a rapid resumption of play after irrigation or natural rain.

The pile of the composite mat has tufted strands that simulate grass and form a "hitting," or "striking," surface. The pile of the composite mat also has loop portions that interact with the lateral strands of the lateral-strength fabric. The plastic foam both encapsulates and physically and chemically bonds to both the lateral-strength fabric and to the looped portions of the pile section to form an integral structure that simulates how the vegetative layer and soil-biomass layer are bonded in natural soil.

A preferred embodiment of the present invention provides a golf practice tee that has a pile made of texturized nylon yarn with pile length of about 1.25 cm (½ inch). In other embodiments of the invention the pile of the turf-simulating composite is made of texturized or untexturized nylon, polypropylene or polyolefin alloy, with or without an extruded coating. The properties of fibers that may be used in different embodiments of the inventions are shown in Table 1. Properties of fibers shown are for illustrative purposes, those of skill in the art will realize that other fibers with other properties may be used within the spirit of the invention.

TABLE 1

| Properties of Fibers | Polyester | Nylon | Aromatic polyamides | Poly-propylene |
|---|---|---|---|---|
| Size/dtex | 1500 | 1500 | 1500 | 1500 |
| Density | 1.39 | 1.14 | 1.44 | 0.95 |
| Tenacity | 9.92 | 10.0 | 20.3 | 6.0 |
| Initial modulus | 146 | 52 | 530 | 40 |

TABLE 1-continued

| Properties of Fibers | Polyester | Nylon | Aromatic polyamides | Poly-propylene |
|---|---|---|---|---|
| Elongation at break (%) | 12 | 19 | 2.2 | 25 |
| Moisture regain % (at 25° C.; 55% RH) | 3–4 | 5–7 | 10–12 | 5–7 |
| Flex fatigue (% retained) | 95+ | 95+ | 75 | 80 |
| Decomposition temp. C.° | 290 | 215 | 382 | 150 |

Other embodiments of the golf practice tee device of the present invention have a pile that is made of strands of texturized nylon yarn or a polyolefin alloy with extruded coating. The loop portions of the pile are tufted, woven, or knitted into a lateral-strength fabric made of polypropylene, aramid, or nylon. Other fibers that may be used to form the lateral strength fabric are listed in Table 1. Other fabrics formed from fibers listed in Table 2 which provide a springy horizontal matrix may also be used.

TABLE 2

| Properties of Fibers | Density (g/cc) | T (gpd) | E (%) | M (gpd) | Wet T (%) |
|---|---|---|---|---|---|
| Fibers - Conventional strength | | | | | |
| Nylon 66 | 1.28–1.34 | 6–10 | 20 | 30–50 | 50 |
| Nylon 6 | 1.14 | 5–10 | 15–40 | 15–55 | 60 |
| Polyester | 1.38 | 5–10 | 10–16 | 100–150 | 95 |
| Acrylic | 1.14–1.18 | 2.5–4.5 | 27–48 | 25–60 | 80–100 |
| Polyolefin | 0.95–0.96 | 5–8 | 10–20 | 25–50 | 100 |
| Polypropylene (commercial) | 0.95–0.96 | 4–9 | 15–35 | 25–100 | 100 |
| High performance fibers - Ultra High Modulus | | | | | |
| Polyolefin | — | 11.8 | 22–32 | 250 | 100 |
| Polypropylene | — | 35 | 22–32 | 1100 | 100 |
| High performance fibers - Aromatic polyamide fibers | | | | | |
| Kevlar 29 | 1.44 | 22 | 4 | 475 | — |
| Kevlar 49 | 1.44 | 22 | 2.5 | 976 | — |
| High performance fibers - Aromatic polyesters | | | | | |
| Ekonol | 1.40 | 27.5–31.0 | 2.4–2.9 | 1100 | — |
| Vectrum | 1.40 | 23 | 3.7 | 530 | — |

Still another embodiment of the invention has a double-ply fabric in which the first ply is a polypropylene type cloth, and the second fabric ply is a spun bonded pick-weave polypropylene fabric. Fabrics suitable for use in the present invention have from 5 to 10 strands per cm (13 to 24 strands per inch). That is, the "grid" of the fabric will be from 5×5 to 10×10 strands per square cm (13×13 to 24×24 strands per square inch). Preferably it is envisaged that the fabric will be from 6×6 to 8×8 stands per square cm (15×15 to 21×21 strands per square inch). Most preferably fabrics with 7.2×7.2 strands per square cm (18×18 strands per square inch) have been found to most suitable.

Other embodiments of the invention have a 0.15 cm (1/16 inch) to 0.6 cm (¼ inch) thick pile loop-portion that interacts with the lateral-strength fabric.

The foam elements of the invention are formed to have densities and resilient properties that differ depending on the particular use to which the embodiment is to be put. Generally, polyurethane foams may be used for the foam elements of the turf simulating composite of the invention.

Polyurethane engineered elements of the present invention are integrally-skinned foams made by preparing a polymerization mixture by mixing an isocyanate source known conventionally in the trade as "Component A" with a polyol source that contains a blowing agent and a catalyst, "Component B." An extensive description of processes for forming polyurethanes and compositions of Components A and B, is found in U.S. Pat. No. 5,451,612, the disclosure of which is incorporated herein by reference. Generally however, the blowing agent of Component B includes a carbonate source, water and an acid source that upon reaction with Component A generates a gas, carbon dioxide, that foams the polymerizing urethanes to form a engineered plastic. Polyurethane engineered elements of the present invention are made by mixing Component A and Component B placing the mixture in a mold to form an integrally-skinned polyurethane element as disclosed in U.S. Pat. No. 5,451,612.

Polyurethane engineered elements of the present invention are made of different densities and resiliencies by mixing Component A and Component B in different ratios. Ratios of Component A to Component B that are found to yield foams particularly suited to the purposes of the present invention range from 45:100, to 51:100. Other ratios are, however, envisaged to be used to make embodiments of the invention to simulate particular conditions. The properties of flexible, integrally-skinned, microcellular polyurethanes are shown in Table 3.

TABLE 3

Properties of Polyurethanes

| | Molded | Flexible molded | Elastomer |
|---|---|---|---|
| Skin Density (lb/cu. ft.) | | 25–65 | |
| Core Density (lb/Cu. ft.) | 1–40 | 5–20 | 21–65 |
| Tensile Strength (psi) | 10–1350 | 20–100 | 10–2500 |
| Compression strength (10% deflection) | 0.25–2500 | — | 10–100 |
| Compression strength (25% deflection) | — | 1–5 | — |
| Compression strength (50% deflection) | — | — | 100–2500 |
| Maximum temperature F.° | 250 | 175 | 250 |

In preferred embodiments of the invention the plastic foam element of the turf-simulating composite is a high-performance foam material with an average cell size of about 0.08 mm and a thickness of about 2.5 cm (1 inch).

The base of a preferred embodiment of the invention is an integrally rimmed base with a primary core and a surrounding secondary core. The primary core is about 3.8 cm (1½ inches) thick and can be thermo-formed polyethylene or polypropylene or engineered polypropylene with a fenestrated or honey-comb structure. Preferably the primary core is an engineered polypropylene. The secondary core of the present invention is about 3.8 cm (1½ inches) thick and is preferably formed of polyethylene or polypropylene. In alternative embodiments of the invention the secondary core may be a foamed plastic element.

The secondary core is made with a recess approximately 1.9 cm (¾ inch) in depth pre-formed in what will be its upper surface. The recess receives and locates an inverted T-shaped tee-block. The recess, together with the thickness of the composite mat, provides a 5 cm (2 inch) standard tee 5 cm (2 inches) of adjustment for tee height. Accordingly, when the turf simulating surface of the present invention is assembled, the inverted T-shaped tee-block is fitted into the recess in the composite base and the main pad and the tee-pad then fit over the tee-block so as to hold the tee-block in place.

Embodiments of the invention described herein additionally comprise an inner elastomer ring cast between the primary core and the secondary core and an elastomer rim cast around the elements of the primary and secondary cores of the base so that the rim becomes integrally associated with the core elements of the base. In preferred embodiments of the invention the edges of the core elements of the base are shaped so that the core elements, the inner elastomer ring and the rim physically interdigitate and chemically bond together when the base is formed.

The integrally formed rim of the base has a generally trapezoidal cross-section with vertical internal surface that, together with the upper surface of the primary and secondary cores, forms a recess that the turf-simulating composite fits into. The trapezoidal rim provides an angled external surface that tapers outwards so that the natural soil around the device can be laid over the angled external surface to securely hold the device down when it is used. Generally the base may be angled from 30° to 50° from the vertical, preferably at 40° from the vertical, however other angles suitable for use in the present invention will be known to those of skill in the art.

Embodiments of the present invention may include a reinforcing bar at the front and rear edges of the base. The reinforcing bars may be of any polygonal shape and are positioned in a pre-formed groove in the secondary core and integrally sealed therein. Preferably the reinforcing bar is aluminum or an alloy thereof and is 2.54 by 0.229 cm (1 inch by 0.090 inch) and is a 150 cm (5 feet) long strip. Reinforcing bars this size provide lateral stability against deflection and creep warping, and maintain horizontal flexibility but impact absorption and reduced bounce. Reinforcing bars may also be fiberglass, carbon fiber, steel, graphite, polyamides or rigid plastics.

An elastomeric plastic is cast into the base mold thereby bonding the primary core, the secondary core and the reinforcing bars together to form the rimmed base. As the elastomer is cast it flows to completely surround and encapsulate the reinforcing bars, core, and to form the rim. Also, as the elastomer cures, it expands to tightly interdigitate with the rough surface of the staggered vertical grooves of the core and so forms an integral structure.

Embodiments of the invention have replaceable tee-blocks that are set into the surface of the golf practice tee device so as to be substantially flush with the surface. Tee-blocks of the present invention have a seam which accepts standard tees. The tee-block comprises a bi-material element comprising a first material which is a dense foam which is cast or extruded to formed an inverted T-shaped element with a centrally positioned slit in the upwardly pointing "leg" of the T-shape. The centrally-positioned slit is lined with a second material comprising a soft tee-retaining gel-foam elastomer. The gel-foam elastomer may be cast, in which case the casting process bonds the gel-foam elastomer to the dense foam inverted T-shaped element. Alternatively, the gel-foam elastomer may be separately produced and affixed in the T-shaped element, for example by the use of two-sided adhesive tape.

Definitions and Terms

Density

The denseness of a material expressed as mass per unit volume, either as pounds-per-cubic-inch, or as grams per cubic centimeter.

Elongation at Break ("E")

Also called "break elongation" is the change in length of a specimen compared to its no-load length at the moment of failure under load. E is usually expressed as percent (%).

Filament

The smallest component of a yarn.

Modulus ("M")

The property describing the resistance of a material to extension. Young's modulus or the "modulus of elasticity" represents the stress required to produce a given stretch or change in length. Modulus is area-specific, that is, it is expressed based on a unit of the original (i.e. no load) cross section. Modulus units are the same as those for "tenacity."

Tenacity/tensile strength ("T")

The ultimate strength exhibited by a material at the moment of failure based on a unit of the original (i.e. no-load) cross section. The most commonly used units are "pounds-per-square-inch" (psi); "grams per denier" (gpd); "Newtons-per-tex" (N/tex), and "pascals" (Pa). Frequently, the term "tensile strength" is used synonymously with "ultimate stress."

Yarn

Bundle or assembly of individual filaments.

Composite Mat

A turf-simulating composite of the present invention with an artificial grass-like surface, a lateral strength fabric and a foamed-plastic core. "Main-pads" and "tee-pads" of the present invention are composite mats.

Rimmed Base

A pre-assembled base in which tee-pads, the main-pad and tee-pads fit to form the assembled turf-simulating surface of the present invention.

Engineered

A form of construction of a plastic cellular panel or sheet referred to in the industry as "honey-comb construction" or "cellular construction." Generally such cellular panels have a fenestrated core which is scrimmed top and bottom with a non-woven plastic fabric. The "primary core" of the present invention is a cellular panel.

The present invention relates to an artificial turf that accurately simulates the basic structures, properties, and dynamics of the grass, vegetative and third layers of natural turf. Accordingly, although embodiments of the invention disclosed herein relate to a novel golf practice surface, application of the present invention to other sports uses is envisaged.

DETAILED DESCRIPTION OF THE INVENTION

The artificial turf invention disclosed herein simulates the performance qualities of natural turf. Particularly, the four-layered structure of golf course turf is simulated by the integral composite of the present invention that comprises an integrally formed pile upper surface, a lateral-strength fabric and one or more plastic foam elements.

Figure 1:
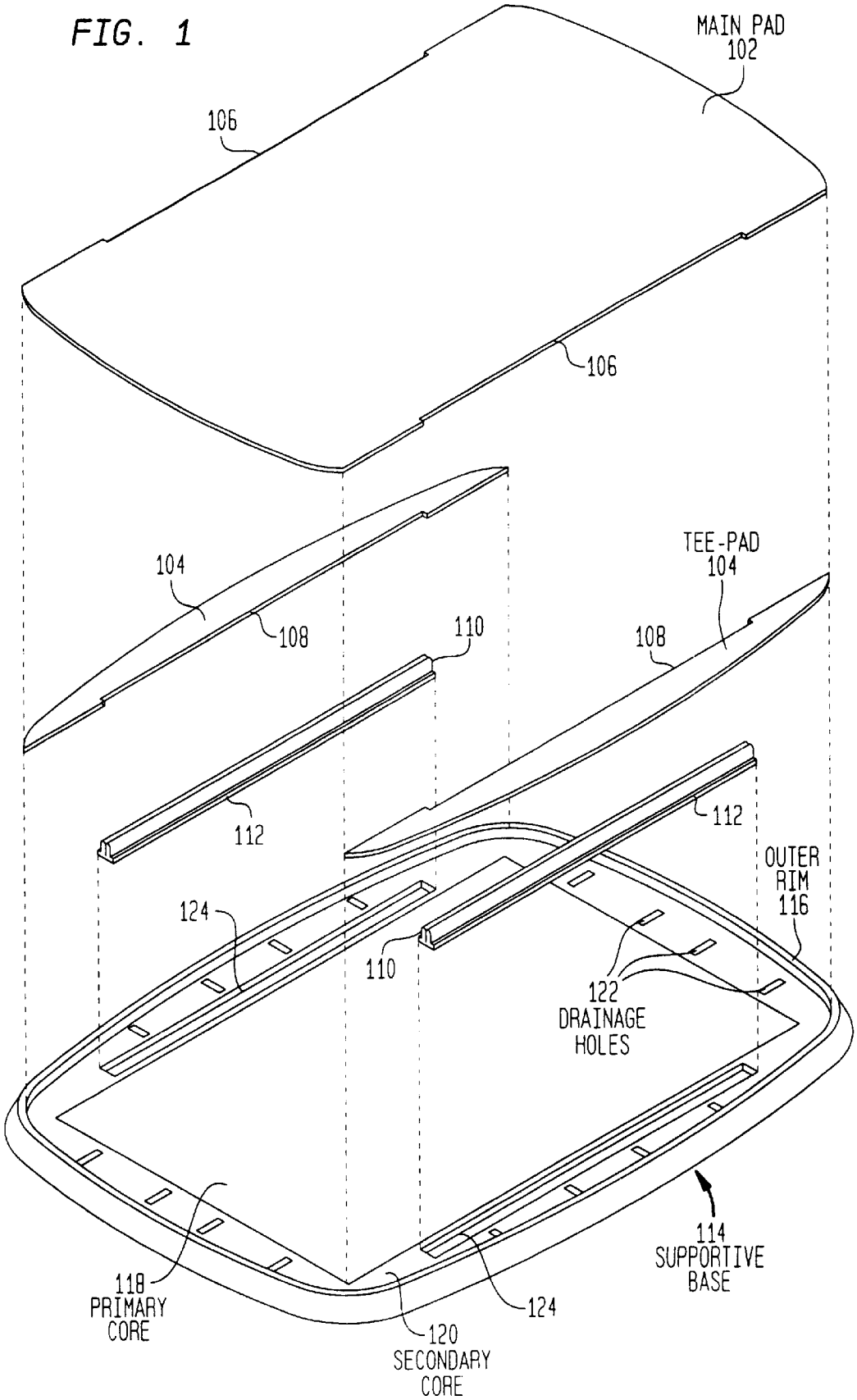
FIG. 1 is an "exploded" perspective view showing the elements of a preferred embodiment of the present invention.

FIG. 1 is a perspective "exploded" diagram of the components of the present invention. FIG. 1 shows the main pad 102 and the tee pads 104 of the turf-simulating composite mat with cut-outs 106 and 108 in each pad that surround the vertically oriented tee-holding flanges 110 of the tee-blocks 112. The supportive base 114 of the invention is shown with the raised rim 116 that locates the main pad 102 and the tee-pad 104. Also shown in the supportive base 114 are the primary core 118, and the secondary core 120 with the positions of drain holes 122 and the recesses 124 that accept the bases of the tee-blocks 112.

The pile surfaces of the present invention are made from fiber forming polymers, one being a lateral-strength fabric of multi-filament wound yarn, the other being an extruded monofilament pile that is processed and knitted, woven or tufted into the fabric. The pile surface and the lateral-strength fabric of the composite mat of the present invention simulate the properties of the grass layer and springiness of the stem layer of natural turf.

Nylon is preferably used for the pile of the present invention because it has a high decomposition temperature. Most preferably, textured nylon is used. Textured nylon is used for two reasons: First, fibers made of textured nylon have a significantly increased crush resistance, and, second, the texturization also helps to counter the burnishing effect of the club head and yields a better product with a longer and more consistent working life. Polypropylene fiber that has been disclosed in the prior art, has been found to have a melting temperature too low for application in the present invention because the friction created by the golf club as it hits the surface of the fiber raises the temperature of the fiber above that at which the material remains stable. The action of the golf club on a low-melting fiber actually decomposes the fiber over time.

Fiber-forming polymers that may be used in the present invention are polyesters, polyamides (e.g. nylon), aramides (e.g. Kevlar, Nomex), polyimides, acrylics and modacrylics, cellulosic polymers, olefinic and vinyl polymers. The properties of fibers that may be used in the present invention are shown in Table 2.

High performance fibers suitable for use in the invention are aromatic polyamides, aromatic polyesters, aromatic polyimides and aromatic heterocyclic polymers. Aromatic high strength fibers are characterized not only by having a high tensile strength, but also by a high tensile modulus. In general, high-strength fibers have a high tensile modulus and exhibit relatively low elongation at break. However, not all fibers with a high tensile modulus have high fiber strength. Any fiber which may be deflected by the club and the ball without stretching and breaking may be satisfactorily used in the present invention.

The properties of the lateral-strength fabric used in the present invention, whether woven or non-woven, depend on the fabric structure and the properties of the constituent yarns and fibers. In natural turf the vegetative layer is the layer that provides a thin, firm, and springy support to the surface. A preferred embodiment of the present invention has a lateral-strength fabric as a backing substrate that effectively simulates the firm and springy characteristics of the vegetative layer. The plastic foam elements of the present invention also have a significant role in simulating the feel of a natural surface. Together, the lateral-strength fabric and the plastic foam elements yield an artificial mat with realistic feel.

An artificial pile layer that is knitted or tufted into a sheet-polypropylene backing is too weak, too deformable and lacks the modulus strength necessary to give an artificial grass with a realistic springy feel. Cloth lateral-strength fabrics are used in the present invention to achieve sufficient strength and to achieve a natural feel.

The backing fabric significantly affects the overall feel of the final surface. To achieve a realistic feel of the artificial device it is critical that the backing material effectively simulates the vegetative layer of grass in exactly the same vertically layered position as occurs in natural turf. This layer has a firm and springy feel, yet is thin enough to allow the club head to easily interact with the layer directly below.

Polyester fibers have been found to give a flexible yet strong, energy-absorbent mat when used as the lateral-strength fabric. These polyester fiber mats absorb and transfer the impact of the club and have a springy but firm feel when a club strikes the surface. Different types of fabrics or combinations of fabrics give a different feel and are used in different embodiments of the invention.

The artificial turf of the invention may be made from several manufactured polymers. The plastic-foam substrates that emulate the root-biomass layer are flexible foams. The durability of plastic foams is significantly related to the chemical bonds present in the foam. For example, foams may be formed with materials having ether- or ester-based linkages. The ether-based foams used in the present invention are substantially more resistant to hydrophilic degradation that ester-based foams. Examples of materials that may be used to form the foam elements of the present invention are in shown in Table 4. Preferably, it has been found that foam elements of the present invention that are on the border of open-celled foams have superior durability when they are formed from substantially closed-celled, polyurethane-based or polyethylene-based foams. However, many types of foam may be used in the present invention, of which the most relevant are urethane, polypropylene, neoprene, polyethylene, and silicone. The foam elements of the present invention are integrally formed with the pile and the lateral-strength fabric, and the invention does not suffer from the de-lamination and degradation problems that affect prior art mats.

All the polymers of this invention are formed by the creation of chemical linkages between relatively small molecules, or monomers, to form very large molecules, or polymers. Thermosetting plastics have chemically cross-linked structures that are formed under the influence of heat; such plastics cannot thereafter be remolded. Other plastics that are chemically set may also not be moldable when warmed. Thermoplastic materials are chemically cross-linked structures that soften when heated, these materials often have molecular structures that are flexible linear or branched molecular structures.

TABLE 4

| Properties of Polymers | | |
|---|---|---|
| THERMOSETTING POLYMERS | ELASTOMERIC POLYMERS | THERMOPLASTIC POLYMERS |
| Alkyds | Acrylate | Acetates |
| Diallyl phthalate | Butyl | Acrylics |
| Epoxies | Chlorosulfonated | Cellulosics |
| Melamines | Polyethylene hypalon | Chlorinated polyethers |
| Phenolics | Fluorocarbons | Fluorocarbons |
| Urethanes - rigid foam | Fluorosilicones | Nylon, polyamides |
| Silicones - rigid resins | Polysulfides | Polycarbonates |
| | Polyurethanes | Polyethylenes |
| | Neoprenes | Polypropylenes |
| | Nitriles | Polyimides |
| | Silicones | Polyphenylene oxides |
| | Styrene | Polystyrenes |
| | Butadienes | Polysulphones |
| | | Vinyls |

Figure 2:
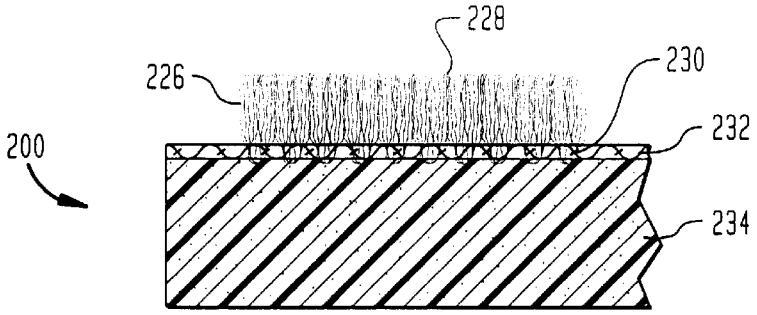
FIG. 2 is diagrammatic representation of a vertical section of a turf-simulating composite of the present invention.

In the present invention, the grass and vegetative layers of natural turf are simulated by a turf-simulating composite mat which is illustrated in FIG. 2. FIG. 2 shows the tufted strands of the turf-simulating composite mat 200 with the simulated grass pile 228 and the loop portion 230 which is interactively positioned in the lateral-strength fabric 232 which is both encapsulated by and physically and chemically bonded with the foamed-plastic element 234.

In natural turf, the root-biomass layer provides a deformable supporting underlayer with structural integrity that holds the turf together and is usually about 3.8 cm (1½ inch) thick. Grass roots from the root-biomass layer penetrate into the root-soil layer, which is of indefinite thickness. The roots help to link the root-biomass layer and the root-soil layer together. The root-soil layer provides a firm base supporting the flexibility of the top three layers and helps to absorb the energy and disperse forces applied to the surface.

Figure 3:
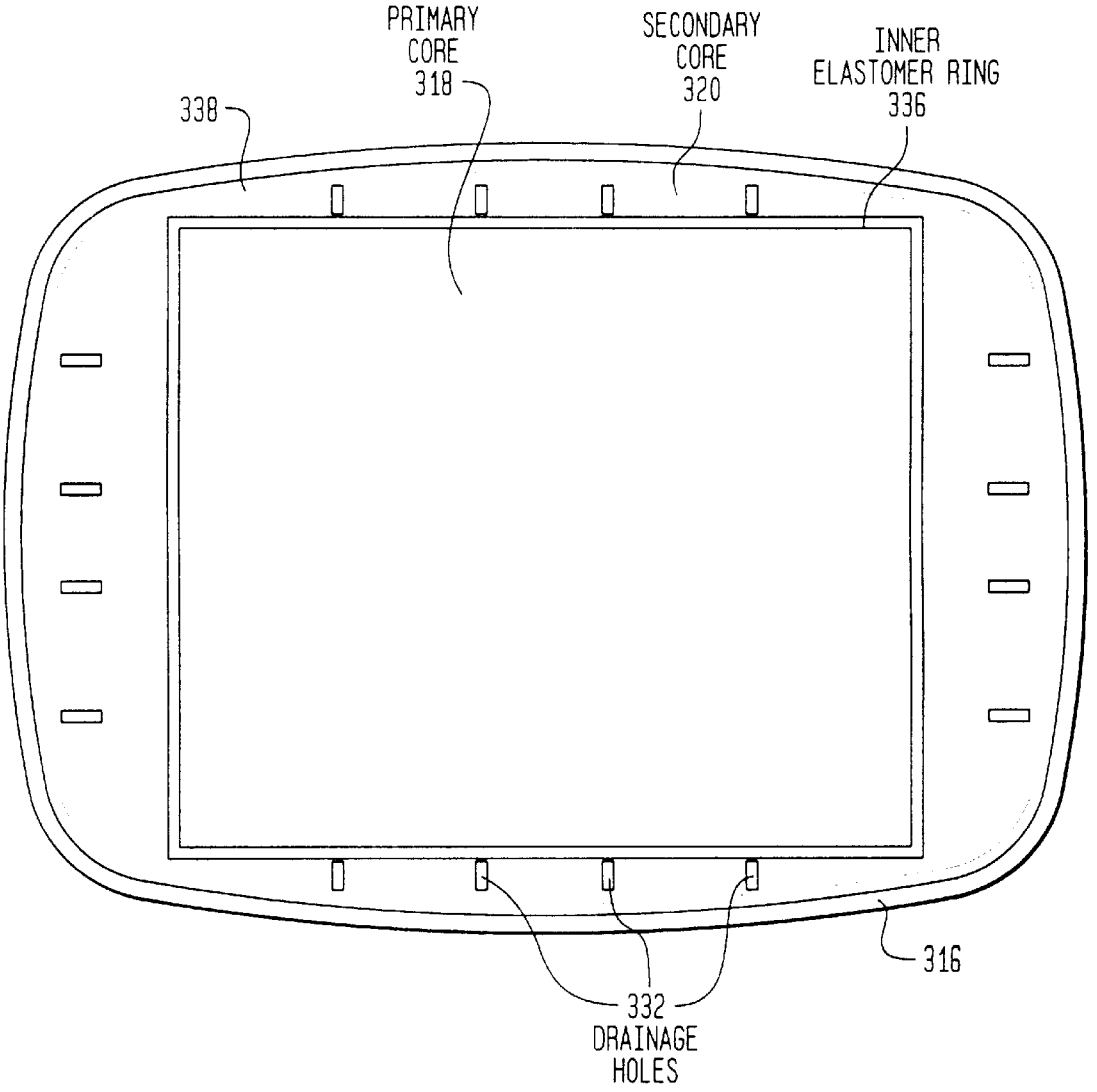
FIG. 3 is a plan view of the lower surface of a supportive base in accordance with the present invention.

FIG. 3 shows a bottom view of a supportive base of the present invention. FIG. 3 shows the primary core 318, the secondary core 320 and the inner elastomer ring 336 that interdigitates with and bonds the primary core 318 to the secondary core 320. Also shown is the elastomer filled groove 338 that retains the reinforcing bar and the drainage holes 322 in the secondary core (for clarity not all drainage hole are identified by reference numerals) together with the elastomer 316 that bounds the secondary core and forms the raised rim on the upper surface.

The primary core of the base of the present invention is preferably an engineered-plastic component that has a resiliency that emulates the physical properties of the root-soil layer of natural turf. Preferably the engineered-plastic component is made of a cellular construction polypropylene thermo-plastic with a polyester scrim on the top and bottom to create a sandwich structure. Such construction provides a much higher relative surface hardness and also provides a higher effective density than the actual intrinsic hardness or density of the materials used. A sandwich construction also enhances the ability of the material to absorb and deflect an impact to a greater extent that if the material were in a solid form. Thermo-plastic polymers are advantageously used in such constructions. A product suitable for this application is produced by Plascore, Zeeland, Mich. The Plascore product comprises a cellular constructed panel with a thermo-plastic core of polypropylene. The density of the Plascore polypropylene is between 57 and 70 Kg per cubic meter (3.6 and 4.4 pounds per cubic foot).

The cellular constructed panel of the present invention may be formed from a homo-polymer, a co-polymer, or a high impact polymer. In a preferred embodiment of the present invention it is formed of polypropylene and the cells are scrimmed top and bottom with a thermo-plastic random fiber polyester non-woven fabric. Alternative constructions comprise woven, tough woven (nylons) or non-woven fabrics used on one or both sides of a cellular core depending on specific applications, material performance capability, or relative density requirements. The dimensions of the preferred primary core are 3.8 cm thick by 100 cm wide by 122 cm long (1½ inches thick by 40 inches wide by 48 inches long) which forms the effective area of the inventions from where the golfer stands and hits. The actual composition of the core is 0.9 grams/cc air and 1.1 grams/cc material. Other embodiments of the present invention have higher or lower densities depending on the construction and/or cell size used. In the preferred embodiment of the invention the construction of the core allows the transfer of water and air molecules, and has physical properties that closely mimic those of a natural golf turf root-soil layer as previously described.

It has been found that thermo-plastic copolymer cellular constructions of polypropylene, aluminum, and polycarbonate cores with aluminum, polyester, or fiberglass scrims may be used for the core in other embodiments of the invention. It has further been found that polymers listed in Table 4 and the fibers listed in Table 2 may be used in the core of the present invention.

Embodiments of the invention with a polypropylene core with a non-woven polyester scrim provide the most effective performance for the product, and lower the core cost by 66% and the core weight by 50%. Such embodiments of the invention have the same impact absorption as a 64 Kg per cubic meter (4 pound per cubic foot) foam core, and provide a base with greater firmness than 192 Kg per cubic meter (12 pound per cubic foot) foam. Resistance to creep deflection is also increased 300% by the copolymer construction and the cell memory is about 95% as opposed to 75% for foam. Additionally, since the construction and materials readily allow the transfer of moisture, the product remains stable in wet conditions.

The particular construction of Plascore-cellular plastic has each cell bonded to every other cell about its circumference. This creates a hinged effect which allows the core to react with greater pliancy to point specific loads such as the impact of the sole of a golf club or the head of a hammer yet to have a greater resistance to deflection across its expanded surface with each cell being supported by every other cell and the constant tension created by the top and bottom scrim.

Surrounding the primary core of the present invention is a secondary core comprising vacuum formed polypropylene or polyethylene. The vacuum formed secondary core provides for the location of the reinforcing rod. The secondary core is bonded to the primary core without the use of adhesives. The secondary core bounds the cavities for the upper components.

Other embodiments of the engineered-plastic core of the base of the present invention may have a single plastic element of engineered polyethylene, foamed polypropylene, thermo-plastic constructions of polpropylene, polycarbonate, or nylon, or a plurality of integrally formed plastic foam elements or thermo-plastic construction with the firmness of each succeeding lower level being greater that the immediately preceding level above.

Figure 4:
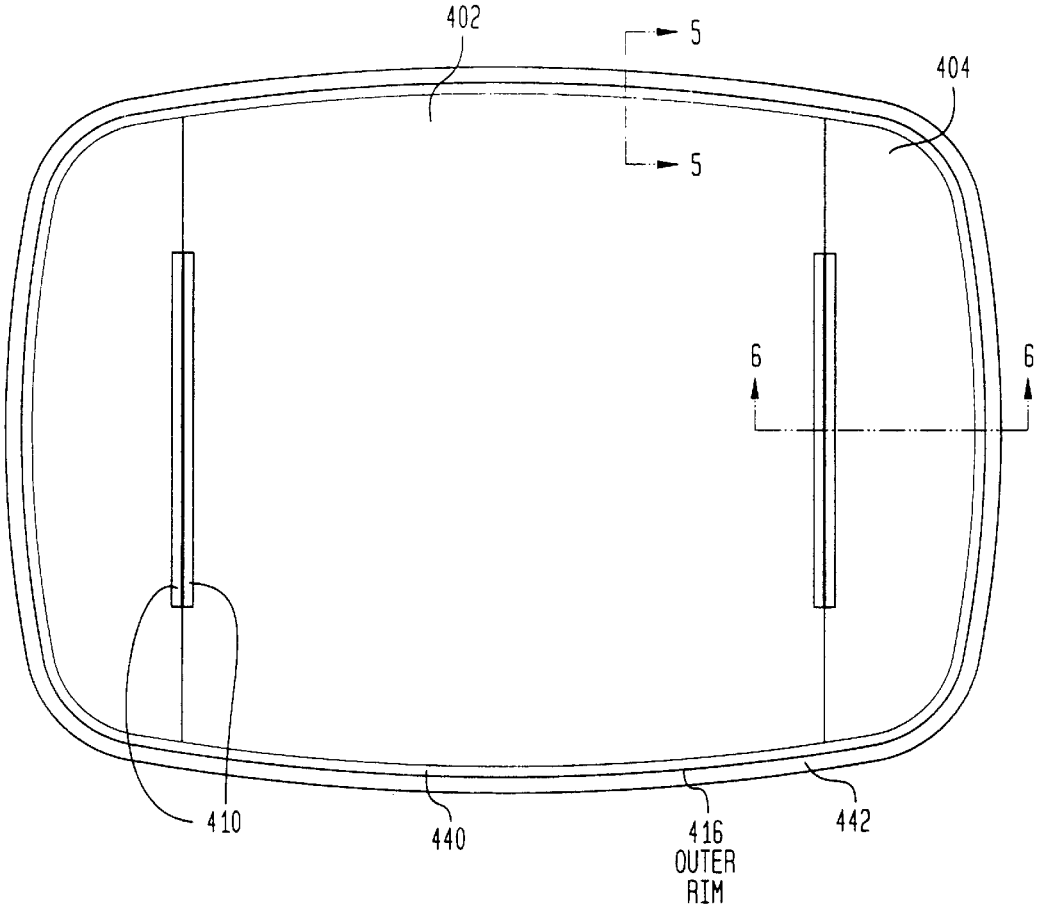
FIG. 4 is a plan view of the upper surface of a preferred embodiment of the present invention.

A top view of the present invention when fully assembled is illustrated in FIG. 4. FIG. 4 shows the main pad 402 and tee pad 404 of the invention flanking the vertical tee-retaining flanges 410 of the tee-block which is hidden beneath the main pad 402 and the tee pad 404. Also shown is the upper edge 440 and the angled sides 442 of the elastomer rim 416 that surrounds the tee pad 404 and the main pad 402 on which the golfer stands. The section cut 5—5 shows the position of the cross section shown in FIG. 5, and the section cut 6—6 shows the position of the cross section shown in FIG. 6.

On natural turf, as a golfer takes a divot and the soil is cut away, the turf has enough pliancy to compress under the sole of a golf club and allow the club head to pass through with little resistance. A preferred embodiment of the artificial turf of the invention disclosed herein has a surface that can accommodate and compress under the sole of a golf club and allow the club head to pass with resistance that is experientially similar to that of play on a natural surface.

Figure 5:
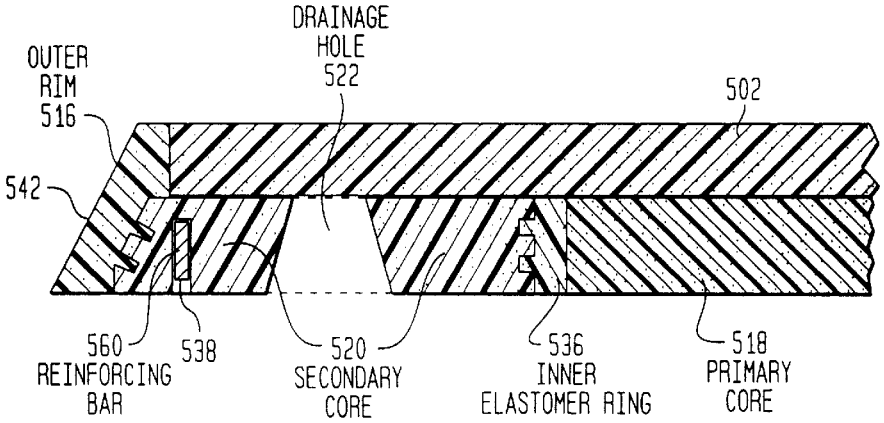
FIG. 5 is a cross-section through the rim of the embodiment of the present invention shown in FIG. 4 taken along line 5—5.

FIG. 5 shows a cross-section through the front rim of the preferred embodiment of the present invention. The raised rim 516 of the base with the angled outer side 542 is shown interdigitating with the secondary core 520. The secondary core 520 is shown with a drainage hole 522 therethrough together with a reinforcing bar 560 located in an elastomer-filed pre-formed groove 538. The inner elastomer ring 536 is shown bonded to the primary core 518 and interdigitating with the secondary core 520. The main pad 502 is shown overlying the primary core 518 and the secondary core 520.

Figure 6:
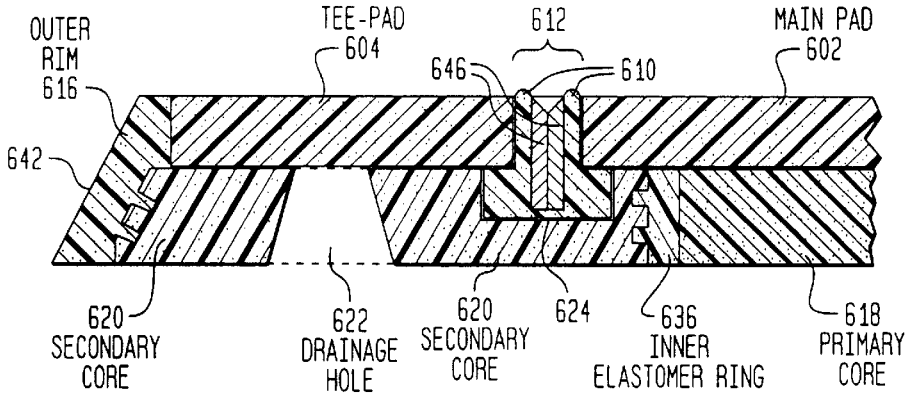
FIG. 6 is a cross-section through the rim of the embodiment of the present invention shown in FIG. 4 taken along line 6—6.

FIG. 6 shows a cross-section through the side of the preferred embodiment of the present invention. The raised rim 616 of the base with the angled outer side 642 is shown interdigitating with the secondary core 620. The secondary core 620 is shown with a drainage hole 622 therethrough and interdigitating with the inner elastomer ring 636. The inner elastomer ring 636 is shown bonded to the primary core 618 and interdigitating with the secondary core 620. A tee-block 612 is shown in recess 624 and the tee-retaining self-tacky gel-foam material 646 is shown on the inner faces of the vertical flanges 610 of the tee block 612. The main pad 602 and the tee-pad 604 are shown overlying the horizontal arms of the tee-block 612 on the primary core 618 and the secondary core 620.

Figure 7:
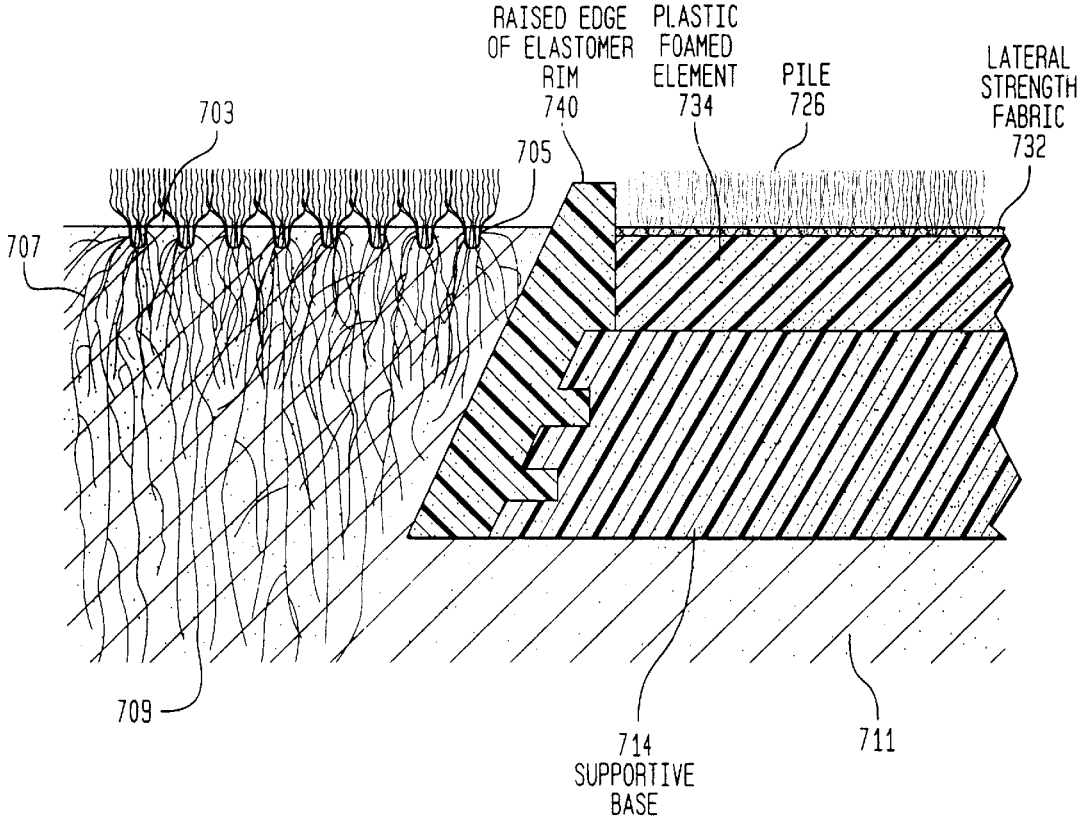
FIG. 7 is a diagrammatic representation of vertical section of a portion of an embodiment of the present invention when emplaced in the ground.

FIG. 7 shows a diagram that compares the four layers of natural turf, namely the grass layer 703, the vegetative layer 705 the root-biomass layer 707 and the root-soil layer 709, compared with the elements of the present invention. The elements of the present invention, namely the tufted strands 726, the lateral-strength fabric 732, the foamed-plastic element 734 of the main pad or the tee pad and the supporting base 714 is placed on the underlying soil 711 and separated from the adjacent natural grass by raised edge of the elastomer rim 740. On natural turf, the golf ball is struck or hit from the surface of grass 703, whereas when playing from the surface of this invention the ball may be hit from the surface of the tufted strands 726.

Embodiments of the present invention provide replaceable tee-blocks adjacent to the hitting surface. The self-tacky gel-foam material of the tee-block allows golfers to use real tees placed in a position and at a height that suits their own individual needs, as would occur in play on a natural surface. In these embodiments, replaceable tee-blocks are located beneath a seam on either side of the hitting surface. These embodiments of the present invention allow for the removal, replacement, or adjustment of the tee-block without affecting the main teeing surface. These embodiments of the invention also allow replacement of portions of the surface which are subject to excessive wear without the need to replace the entire playing surface.

Other tee-blocks of the preset invention have a form similar to the composite mat of the invention and have a engineered-plastic element integrally formed with the lateral-strength fabric and the pile.

To accommodate tee-blocks of the present invention, a recess 1.9 cm (¾ inch) deep is molded into the base. The recess together with the 2.5 cm (1 inch) thickness of the pad allows the use of standard tees with the present invention. In use, the first component material of the tee-block acts as a housing for the second component material, which is a soft, self-tacky gel-foam that functions to grip the tee while it is in the tee-block. The first component material has excellent impact resistance and retains its shape, but has sufficient pliancy to give on impact so as not to create any adverse bounce or feedback to the golfer. The inverted T-shaped block is stably located in a recess formed in the base and is held in place by the overlying main pad and tee-pad. The first component material of the tee-block also acts as a bumper to protect the bond between the turf and foam of the main pad and the tee-pad and the junction with the tee block which would otherwise be exposed. The first component material also acts to protect the fragile gel-foam from damage when used to hold the tee.

The gel-foam is cast onto the first component material in a two part process. The gel-foam is soft and tacky and as such does not hold its form well. The gel-foam does however hold a tee very much in the manner of natural turf. Using the tee-block of the present invention, a standard tee can be positioned according to the players preferences for ball height and stance placement—e.g., inside the front heel for woods or in the middle of the stance for irons—without the golfer having to move his position just as would occur under actual playing conditions. The gel-foam holds a tee much more effectively than other materials and in some ways is better than natural turf. For example, if a standard tee is held too firmly it will break too easily and too often. Conversely if it is held too loosely by a material it will fly out too easily, forcing the golfer to search for or abandon the tee. Standard tees in turf break about 10% of the time and, if they fly out will generally remain within a 180 cm (6 foot) radius. Tees held by the gel-foam tee-block of the present invention break only about 5% of the time and tend to remain within a 60 cm (2 foot) radius when they fly out. This substantial improvement arises because the tee-block provides a continuous seam that permits the tee to turn before material failure occurs. Further, the gel-foam is sufficiently tacky to grab enough of the tee when it is being pulled out of the seam so that most of the tee's momentum is eliminated.

Figure 8:
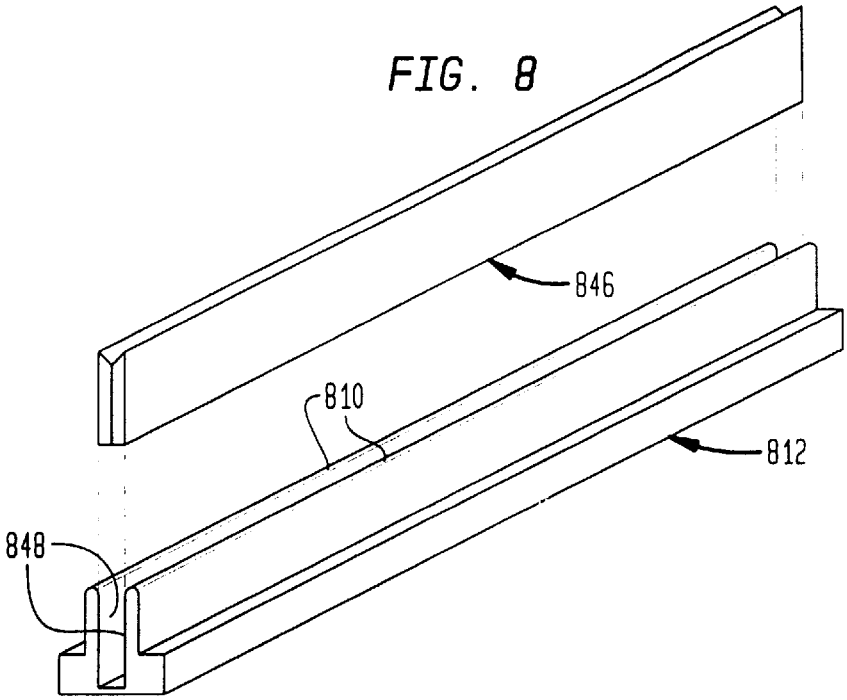
FIG. 8 is an "exploded" perspective view showing the elements of a tee-block of the present invention.

FIG. 8 shows a perspective drawing of the elements of the tee-block of the present invention. The inverted T-shaped tee-block 812 is shown and the tee-retaining self-tacky gel-foam material 846 is shown dissembled from the inner faces 848 of the vertical flanges 810 of the tee block 812.

Figure 9:
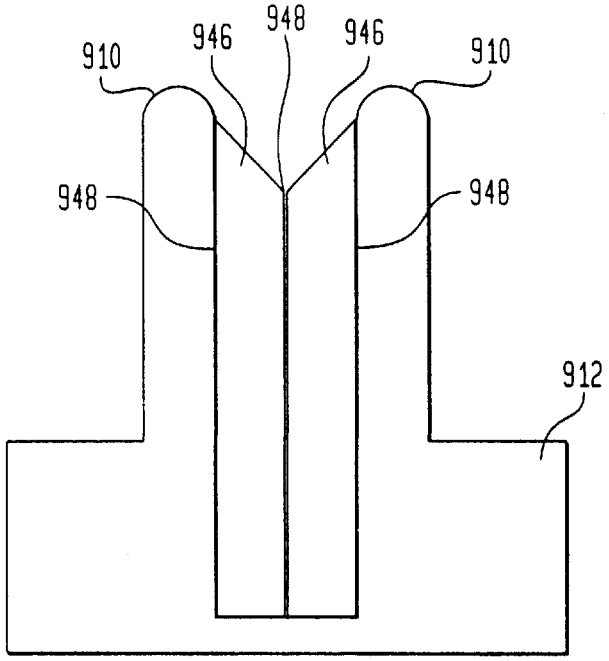
FIG. 9 is an end-view of a tee-block of the present invention.

FIG. 9 show an end-view of a tee block of the present invention. The inverted T-shaped tee-block 912 is shown with the gel-foam layers 946 positioned on the facing surfaces 948 of the vertical tee-retaining flanges 910 in the inverted T-shaped element 912. Also shown is the seam 948 into which a tee is inserted during play or practice.

In some embodiments of the invention, the rimmed base of the second component is integrally formed around a foamed-plastic cellular composite core. Other embodiments are formed without such a rimmed base. To achieve improved integrity of the base component, the rim of certain embodiments of the present invention are reinforced with reinforcing bars and the edge of the engineered-plastic core is be shaped to interdigitate with the rim.

The edges of the engineered-plastic core may be variously shaped to provide interlocking surfaces, before formation of the rim around the core. (See, for example, U.S. patent application Ser. No. 08/881,341).

Embodiments of the present invention are rectangular and may be eight by twelve feet in size or of any other size, shape or dimension that suits the needs of a golf practice range. Embodiments of the invention may be made without a rim surrounding the hitting surface.

The present invention addresses problems not successfully addressed by the prior art. An artificial golf mat should do more than merely have a grass-like appearance. The present invention effectively simulates both the physical energy absorbing properties of natural turf and has similar force absorbing and feedback qualities and simulates the appearance of natural turf. In the present invention a composite mat simulates the properties of the upper layers of natural turf and a base layer simulates the supportive properties of the deeper layers of natural turf.

To further illustrate the invention, the following examples are provided. However, it is to be understood that these examples are for illustrative purposes only and that many variations and combinations of elements may be used as will be clear to those of skill in the art.

EXAMPLE 1

An exemplary embodiment of the turf-simulating composite of the present invention has an artificial surface of 1.25 cm (½ inch) long pile formed of a texturized nylon yarn that is tufted into a two-ply lateral-strength fabric backing. One ply of the lateral-strength fabric used in this example of the invention is a polypropylene cloth-type fabric. The other ply of the lateral-strength fabric is a polypropylene pick-weave fabric of 7.2 strands per cm (18 strands per inch) which also has some spun bonding. The polypropylene pick-weave fabric gives a strong tuft bind and the spun bonding reduces the brittle-plastic feel of the fabric. The amount of spun bonding is selected to modify the overall feel of the final surface and to control the bleed-through of the foam and promote the encapsulation of the nylon yarn.

The integral foam layer of the turf-simulating composite of the exemplary embodiment is formed of MC-10-5964 two-part, microcellular, flexible, polyurethane foam, obtainable from Flexible Products Company, Marietta, Ga. In this embodiment of the invention, Component A and Component B of the polyurethane precursor components are mixed in a ratio of 51 parts to 100 parts respectively by weight, and reacted in a mold to yield a foam density of about 160 Kg per cubic meter (10 pounds per cubic foot). The integral foam layer of this exemplary embodiment is 2.5 cm (1 inch) thick and self-skinned on the sides and the bottom of the finished mat. The upper surface of the integral foam layer is formed by the penetration of the two-ply lateral-strength fabric by the polyurethane precursor components as formation of the turf-simulating composite occurs by polymerization.

The base of the turf-simulating composite of the exemplary embodiment is an integrally-rimmed base formed of 5 cm (2 inch) thick medium density foamed polyethylene of about 144 Kg per cubic meter (9 pounds per cubic foot). An example of such foamed polyethylene known as "Polyplank® White 9 PCF" is manufactured by Astro-Valcour, Inc., Glens Falls, N.Y.

EXAMPLE 2

A turf-simulating composite of the present invention as described in Example 1, but formed by reacting a mixture of Component A and Component B of the polyurethane precursor components in a ratio of 54 parts to 100 parts respectively by weight. This exemplary embodiment of the invention has a increased resiliency compared to that disclosed in Example 1.

EXAMPLE 3

A turf-simulating composite of the present invention as described in Example 1, formed with a lateral-strength fabric that has the form of a commercially available cord-type knitted fabric. This exemplary embodiment of the invention provides a grass-like surface with increased responsiveness compared to that disclosed in Example 1.

EXAMPLE 4

A turf-simulating composite of the present invention as described in Example 1, formed with a lateral-strength fabric that has the form of a commercially available polyester loop-pile fabric that is mechanically linked by a knotting process and bonded with a 0.3 cm (⅛ inch) foam layer. This exemplary embodiment of the invention provides a grass-like surface whose strands are differently and more securely located in the mat and with greater lateral strength compared to that disclosed in Example 1.

EXAMPLE 5

Materials suitable for use in the present invention are made by Flexible Products Company, Marietta Ga. A microcellular flexible polyurethane foam suitable for use in the main pad and tee pads of the present invention is the MC-7-5965 system. Such a system comprises two components (A and B) which when mixed together form a self-blowing foam that has a free rise density of 112 to 128 Kg per cubic meter (7 to 8 pounds per cubic foot).

A urethane elastomer suitable for use in the inner elastomer ring and the rim of the present invention is FLEXI-POL ME-90. Such an elastomer comprises two components (A and B) which when mixed together form a polymer with a density of about 1,120 Kg per cubic meter (70 pounds per cubic foot).

A hard polyurethane foam suitable for use in the T-shaped element of the tee-block of the present invention is the FSF-MW8.5-6961 system. Such a system comprises two components (A and B) which when mixed together form a self-blowing foam that has a free rise density of 168 to 200 Kg per cubic meter (10.5 to 12.5 pounds per cubic foot).

The present invention is illustrated by reference to the preceding disclosure. Those of skill in the art will readily appreciate that the present invention is well adapted to carry out the objects and obtain the ends and advantages mentioned, as well as those inherent therein. The components, methods, procedures and techniques described herein are exemplary, and are not intended as limitations on the scope of the present invention. Changes therein and other uses will occur to those skilled in the art which are encompassed within the spirit of the invention and the scope of the appended claims.

Having described the invention, what it is desired to claim by Letters Patent is:

1. A turf-simulating surface comprising a pad comprising turf-simulating composite, a supportive base and an outer rim surrounding said supportive base, wherein:

said pad comprises a pile section, a lateral-strength fabric and a plastic foam element;

said pile section comprising a filament portion and a loop portion interactively associated with said lateral-strength fabric;

said plastic foam element being formed to encapsulate and physically bond to said lateral-strength fabric layer and to said loop portion of said pile section;

said supportive base comprises a primary core and a secondary core encircling said primary core, and an inner elastomer ring;

said primary core having a cellular construction;

said secondary core comprising vacuum formed polypropylene or polyethylene and being fenestrated to provide drainage holes;

said inner elastomer ring integrally associating said primary core with said secondary core; and said outer rim comprises an elastomer that physically interdigitates with and chemically bonds to said secondary core.

2. The turf simulating device of claim 1, additionally comprising:

tee-blocks with vertically oriented tee-holding flanges; and wherein;

said pad comprises a main pad and tee pads;

said supportive base with a rim laterally positions said main pad and said tee-pads;

said main pad and said tee pads have cut-outs to surround said vertically oriented tee-holding flanges, and said secondary core has recesses to accept said tee-blocks.

3. The turf simulating device of claim 2, wherein:

fibers of said pile section are selected from the group consisting of polyamide, polyester, acrylic, polyolefin, polypropylene, aromatic polyamide and aromatic polyester.

4. The turf simulating device of claim 2, wherein:

fibers of said lateral strength fabric are selected from the group consisting of polyamide, polyester, polyolefin, polypropylene, aromatic polyamide and aromatic polyester.

5. The turf simulating device of claim 2, wherein:

said plastic foam element has a thickness of about 2.5 cm and is formed of polyurethane foam with an average cell size of about 0.08 mm.

6. The turf simulating device of claim 1, additionally comprising reinforcing bars.

7. The turf simulating device of claim 6, wherein:

said secondary core has pre-formed grooves adjacent to front and rear edges thereof, and said reinforcing bars are integrally sealed within said grooves.

8. The turf simulating device of claim 6, wherein:

said reinforcing bars are made of a material selected from the group consisting of aluminum, alloys of aluminum, fiberglass, carbon fiber, steel, graphite, polyamides and rigid plastics.

9. The turf simulating device of claim 1, wherein:

said primary core is cellular polypropylene with a polyester scrim on the surfaces thereof.

10. The turf simulating device of claim 9, wherein:

said cellular polypropylene is about 3.9 cm thick.

11. The turf simulating device of claim 1, wherein:

said secondary core is made of fenestrated plastic formed by a process selected from the group consisting of thermo-forming, spin-forming, rotational injection molding, blow molding and casting or is foamed plastic.

12. The turf simulating device of claim 1, wherein:

said inner elastomer ring physically interdigitates with and chemically bonds to said primary core and said secondary core.

13. The turf simulating device of claim 1, wherein:

the edges of said primary and secondary cores are shaped so that the cores, said inner elastomer ring and said outer rim physically interdigitate and chemically bond together when said supportive base is formed.

14. The turf simulating device of claim 2, wherein:

said vertically oriented tee-holding flanges of said tee-blocks additionally comprise self-tacky gel-foam elements on the facing surfaces of said tee-holding flanges.

15. The turf simulating device of claim 2, wherein:

said tee-block comprises:

a generally T-shaped element including two vertically oriented flanges;

said vertically oriented flanges having on the facing surfaces thereof a tee-retaining material;

whereby, when said T-shaped element is inverted, said vertically oriented flanges provide a tee-receptive slit which allows natural-like positioning of golf tees.

16. The turf simulating device of claim 15, wherein:

said tee-retaining material is a self-tacky gel-foam comprising a cast elastomer or an extruded thermo-plastic polymer.

* * * * *